US008413477B2

(12) United States Patent
Bauer et al.

(10) Patent No.: US 8,413,477 B2
(45) Date of Patent: Apr. 9, 2013

(54) CALIBRATION TOOL FOR FABRICATING DISK SPRINGS

(75) Inventors: Fabian Bauer, Kippenheim (DE); Dianne Shelly, Wooster, OH (US); Kunding Wang, Copley, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 576 days.

(21) Appl. No.: 12/383,828

(22) Filed: Mar. 26, 2009

(65) Prior Publication Data

US 2010/0071437 A1 Mar. 25, 2010

Related U.S. Application Data

(60) Provisional application No. 61/070,875, filed on Mar. 26, 2008.

(51) Int. Cl.
*B21D 22/00* (2006.01)

(52) U.S. Cl.
USPC ..... 72/347; 72/31.01

(58) Field of Classification Search ..... 72/347, 72/348, 353.2, 353.3, 381, 382, 383, 384, 72/31.01
See application file for complete search history.

(56) References Cited

U.S. PATENT DOCUMENTS 6,463,782 B1 * 10/2002 Shen et al. ..... 73/1.79
7,131,311 B1 * 11/2006 Kihara et al. ..... 72/359
7,934,410 B2 * 5/2011 Myers et al. ..... 72/348

* cited by examiner

*Primary Examiner* — Edward Tolan
*Assistant Examiner* — Homer Boyer
(74) *Attorney, Agent, or Firm* — Alfred J. Mangels

(57) ABSTRACT

A calibration tool for fabricating disk springs. The tool includes a circular cylindrical tool body having an insertion bevel at its face end portion for receiving and centering a workpiece within an inner circumferential enveloping surface of the tool body. A tool surface at the inner circumferential enveloping surface aligns the workpiece relative to a forming tool disposed within the inner circumferential enveloping surface. The tool surface includes a first portion having an inner diameter that increases in size along the axial longitudinal direction of the tool body, and a second portion with an inner diameter that decreases in size along the axial longitudinal direction of the tool body.

10 Claims, 1 Drawing Sheet

CALIBRATION TOOL FOR FABRICATING DISK SPRINGS

BACKGROUND OF THE INVENTION

1. Field of the Invention

The present invention relates to a calibration tool for fabricating disk springs, the tool including a circular cylindrical tool body having an insertion bevel at its face end portion for receiving and centering a workpiece within an inner circumferential enveloping surface of the tool body, and having a tool surface at the inner circumferential enveloping surface for aligning the workpiece relative to a forming tool disposed within the inner circumferential enveloping surface.

2. Description of the Related Art

Disk springs of that genus are provided, e.g., for application in friction clutches of motor vehicles, wherein they provide the contact pressure required for pressing the friction lining against a flywheel at the torque output of an exemplary internal combustion engine of a motor vehicle. Such disk springs are made in a forming process from a blank provided in the shape of a circular disk.

In order to prevent the occurrence of speed variations in the drive train of a motor vehicle configured with such a friction clutch, it is important for the fabricated disk spring to have a symmetrical structure, so that it can, e.g., not happen that the circumferentially spaced tongues of the disk spring impart upon the friction liners or upon the flywheel normal force components that differ significantly from one another.

Thus, the fabrication of disk springs is typically completely automated, so that a blank is inserted into the die cavity of a forming tool by a handling apparatus, and then the blank is formed into a disk spring through the association of pressure and heat in the forming tool.

In order to prevent the speed variations recited above, the blank has to be centered relative to the die cavity or relative to the forming dies disposed thereabout. For that purpose, the forming tool includes a circular cylindrical tool body that includes an insertion bevel at one face end portion for receiving and centering the workpiece within an inner circumferential enveloping surface of the tool body. The handling apparatus transports the blank through the insertion bevel into the die cavity, so that the forming tool can close subsequently in order to form the blank in the die cavity.

An important component of the forming tool is thus the circular cylindrical tool body recited above, which includes a tool surface at its inner circumferential enveloping surface, which tool surface is used for aligning the workpiece relative to the forming tool disposed within the circumferential enveloping surface.

The tool configured with the tool surface at the inner circumferential surface is used for centering or calibrating the workpiece relative to the forming tool, and is therefore subsequently designated as calibration tool or calibration ring.

A known calibration tool illustrated in FIG. 1 of the attached drawing includes the insertion bevel recited above at its upper face end portion, through which the blank to be formed into a disk spring is inserted into the die cavity between an upper die and a lower die and can be centered there.

The lower end of the insertion bevel viewed in the axial longitudinal direction includes an inner diameter, which is equal to the inner diameter of the first die portion subsequent to the insertion bevel. In that first die portion, thus the tool surface includes a straight inner circumferential enveloping surface, viewed in that axial longitudinal direction of the calibration tool, which is used for centering the workpiece during approximately the first half of the operating movement of the upper die relative to the lower die of the forming tool.

The first shaped portion of the known calibration tool shall therefore be used to prevent a radial displacement of the workpiece relative to a support surface configured at the lower die during the feed movement of the upper die relative to the lower die.

It has now become apparent, that grinding- or scratching marks occur at that first shaped portion of the known calibration tool, which originate from a physical contact of the blank and the calibration tool in the first shaped portion. The physical contact between the blank and the first shaped portion of the known calibration tool therefore leads to a normal force loading of the outer circumferential enveloping surface of the blank towards the center of the blank, and thus leads to an upset.

Thereby, internal stress is induced in the blank which leads to a warping of the blank, and thus to a nonsymmetrical disk spring with reference to the axis of symmetry extending through the center of the blank. The spring force of disk spring tongues disposed in such a portion can therefore differ from the spring force of disk spring tongues disposed outside of that portion.

It is therefore an object of the present invention to provide a calibration tool, which avoids the forming of such upset or warped portions of the disk spring. Furthermore, a forming tool is to be provided that is configured with the calibration tool in accordance with the invention.

SUMMARY OF THE INVENTION

Thus, the invention includes features in order to achieve that object with respect to the calibration tool. Advantageous embodiments thereof are described hereinafter. The invention furthermore includes features with respect to the forming tool, wherein an advantageous embodiment is described.

The invention thus provides a calibration tool for fabricating disk springs, wherein the calibration tool includes a circular cylindrical tool body, which includes an insertion bevel at its face end portion for receiving and centering a workpiece within an inner circumferential enveloping surface of the tool body, and a tool surface at the inner circumferential enveloping surface for aligning the workpiece relative to a forming tool disposed within the inner circumferential enveloping surface, wherein the tool surface includes a first portion with an inner diameter increasing in size along the axial longitudinal direction of the tool body, and a second portion with an inner diameter decreasing in size along the axial longitudinal direction of the tool body.

The configuration of the calibration tool in accordance with the invention, with a first shaped portion or portion with an inner diameter increasing in size along the axial longitudinal direction of the tool body, takes into consideration that the movement path of a point disposed on the blank at the outer diameter deviates during the feed movement of the upper die relative to the lower die from a straight path, as it corresponds to the straight configuration of the inner circumferential enveloping surface of the calibration tool in the first shaped portion.

Thus, when the upper die is lowered onto the blank supported at the contact surface of the lower die, the movement of the blank in the portion between the contact surface and the point of the blank disposed at the outer circumference equals a rotational movement about a support point located within the support surface as a point of rotation, so that a movement path of the point is generated that equals a circular movement with the support point of the blank at the lower die as a point of rotation.

Thus, that finding now also explains the occurrence of grinding- or scratch marks at the straight first shaped portion of the known calibration tool. The first portion of the tool surface, whose inner diameter increases in the axial longitudinal direction of the tool body, now assures that a physical contact between the workpiece and the tool surface in the first portion only occurs when a sliding of the workpiece from its centered position relative to the lower die and to the upper die is imminent, but no physical contact occurs when the workpiece maintains its center position relative to the dies during the forming process, so that the disadvantageous upsetting and warping of the workpiece does not occur anymore.

The movement path of the point located at the outer diameter of the blank or of the workpiece follows a circular movement about the support point at the lower die, so that a radially inwardly directed movement follows after the radially outwardly directed movement in the portion of the first portion of the tool surface; thus, both movements occur relative to the axis of symmetry extending through the center point of the blank. Thus, to accommodate that movement path, the tool surface includes a second portion with an inner diameter that decreases in size along the axial longitudinal direction of the tool body.

The configuration of the calibration tool in accordance with the invention now provides that the target diameter of the disk spring is controlled by the outer diameter of the blank, and is not controlled anymore by the calibration ring or by the calibration tool. Put differently, that means that the calibration ring in accordance with the invention does not cause an upset and thus warping and thus imparting undesirable internal stress into the workpiece, as is the case with the known calibration ring, but only establishes a physical contact between the blank and the calibration ring in accordance with the invention, when the blank is about to slide out of its centered position during the forming process.

Contrary to that, the target diameter of the completed disk spring in the known embodiment was adjusted by the calibration ring with the undesirable consequences of inducing internal stress in the competed disk spring.

In accordance with an improvement of the invention it is provided that the first portion is disposed adjacent to the insertion bevel. That configuration facilitates the implementation of a first contact of the blank by the upper die of the forming tool directly below the lower end of the insertion bevel, since the blank reacts to that with the circular movement path described above, and the calibration tool in accordance with the invention facilitates that by the diameter expansion configured at the tool surface in its first portion.

In accordance with an improvement of the invention it is provided that the first and the second portion are disposed adjacent to one another. That configuration causes a centering effect through the tool surface of the calibration ring and prevents an upset during an undesired sliding of the blank during the forming process during the circular movement path of the point at the outer diameter of the blank when required.

Viewing now the tool surface in a sectional view, including a longitudinal axis of the tool body, it is provided in accordance with the invention that the tool surface in the portion of the first and second portion includes a circular segment shaped indentation.

That indentation in the portion of the first and second diameter provides a diameter change of the inner diameter of the tool surface in the axial direction of the calibration tool, which provides the spreading space required for the radial spreading of the outer diameter of the blank during deformation.

The inventors found that the movement path of points disposed on the outer diameter of the blank during the forming process in the first and second portion corresponds to a circular segment shaped trajectory, therefore it is provided in accordance with an improvement of the invention that the tool surface in the first and second portion includes a shape in a sectional view including a longitudinal axis of the tool body, which largely corresponds to the movement path of a point on the outer diameter of the workpiece, while being formed into a disk spring.

That configuration has the advantage that the tool surface counteracts an undesired deviation of the blank during the fabrication of the disk spring through a desired centering effect, though the blank is not upset during fabrication, which is the case with the known calibration ring.

In accordance with an improvement of the invention it is provided that the tool surface includes a third portion, with substantially constant inner diameter, adjacent to the second portion. That configuration of the tool surface considers the finding of the invention that the movement path of a point on the outer diameter of the workpiece after the circular segment shaped curved portion corresponds to a translatory movement occurring in the axial longitudinal direction of the calibration tool.

Thus, viewing the tool body in a sectional view comprising the longitudinal axis of the tool body, the ratio of the length of the portion of the tool surface configured with a variable inner diameter to the length of the portion configured with a substantially constant inner diameter corresponds to a ratio of approximately 2:1.

Put differently, that means that the length of the tool surface in the sectional view is divided into two portions at a ratio of approximately two thirds of the length of the tool surface with a variable inner diameter and approximately one third of the straight tool surface configured with a constant inner diameter.

Eventually, the invention also provides a forming tool for fabricating disk springs including an upper die and a lower die that together define a die cavity for receiving a workpiece to be formed into a disk spring, wherein the die cavity is enclosed by a calibration tool as described above.

The calibration tool in accordance with the invention thus facilitates that the workpiece is not subjected to a force loading in radially inward direction during the forming process into a disk spring, which force loading occurs with reference to the axis of symmetry or the longitudinal center axis of the blank, which leads to upsetting and warping, but only comes into contact with the tool surface when the workpiece is about to slide from its centered position relative to the lower or upper die.

Thus, the calibration tool in accordance with the invention facilitates the formation of symmetrical disk springs in a desirable manner, to which are not imparted undesirable internal stresses during fabrication or during the forming process.

BRIEF DESCRIPTION OF THE DRAWING

The structure, operation, and advantages of the present invention will become further apparent upon consideration of the following description, taken in conjunction with the accompanying drawings in which.

DESCRIPTION OF THE PREFERRED EMBODIMENTS

Figure 1:
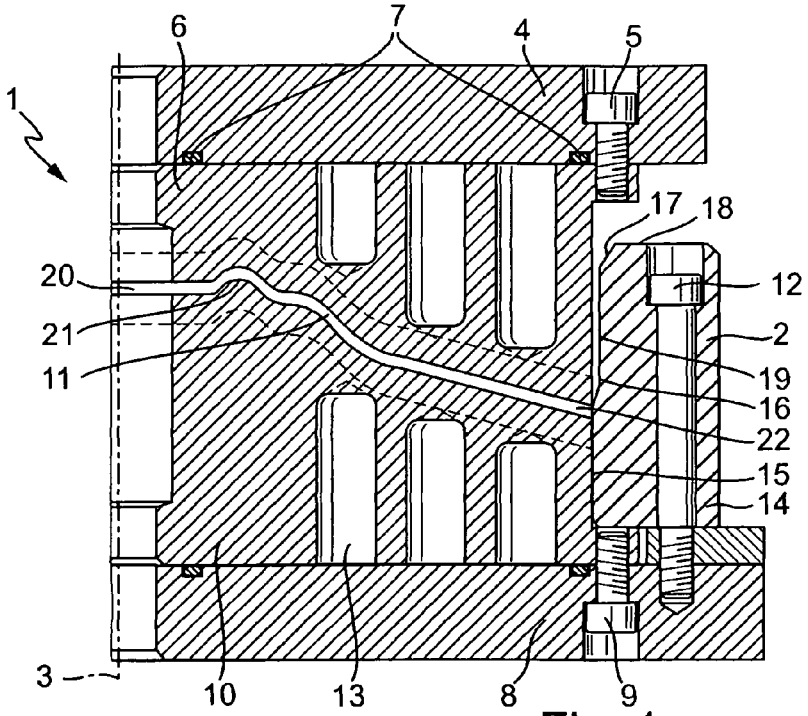
Fig. 1 Prior Art
FIG. 1 shows a sectional view of a known forming tool with a known calibration tool.

FIG. 1 of the drawing shows a sectional view of the right half of a known forming tool 1 for fabricating disk springs with a known calibration tool 2, wherein the dot dashed line 3 shows the longitudinal center axis or axis of symmetry of the illustrated configuration.

An upper die 6 can be mounted to an upper cover plate 4 by threaded bolts 5, wherein seal element 7 can be disposed therebetween.

In a similar manner, a lower die 10 can be removably mounted at a bottom plate 8 by threaded bolts 9.

Between the upper die 6 and the lower die 10, a die cavity 11 is formed in which a workpiece can be received in the shape of a blank, from which the disk spring is fabricated through a forming process.

The calibration tool 2 is removably mounted to the bottom plate 8 through threaded bolts 12.

Through coolant bore holes, designated with the reference numeral 13, coolant can be transported into the upper die 6 and into the lower die 10, in order to cool the workpiece disposed in the die cavity 11.

As is readily apparent, the calibration tool 2 includes a circular cylindrical tool body 14, which has a tool surface 16 at its inner circumferential enveloping surface 15.

An insertion bevel 17 is provided at the face end portion 18 of the tool body 14, which is on top in the drawing plane, which insertion bevel is used for receiving and centering a workpiece configured as a circular disk shaped blank, from which the disk spring is fabricated, within the inner circumferential surface of the calibration tool 2.

As is clearly evident, the tool surface 16 of the known calibration tool 2 includes a first shaped portion 19 with linear extension in the portion adjacent to the insertion bevel 17 in the axial direction.

When the workpiece disposed in the die cavity 11 moves into the capture portion of the upper die 6 when the forming tool 1 closes, the workpiece 20 is supported at an annular support surface 21 of the lower die 10.

Closing the forming tool 1 leads to the forming of the workpiece 20, during which the outer diameter portion 22 at the first shaped portion 19 is pressed downward while contacting said shaped portion, and is upset at that location in a radially inward direction, since the calibration tool 2 is configured rigid. That leads to distortions of the workpiece 20, and thus to an undesirable induced internal stress into the disk spring thus fabricated.

Figure 2:
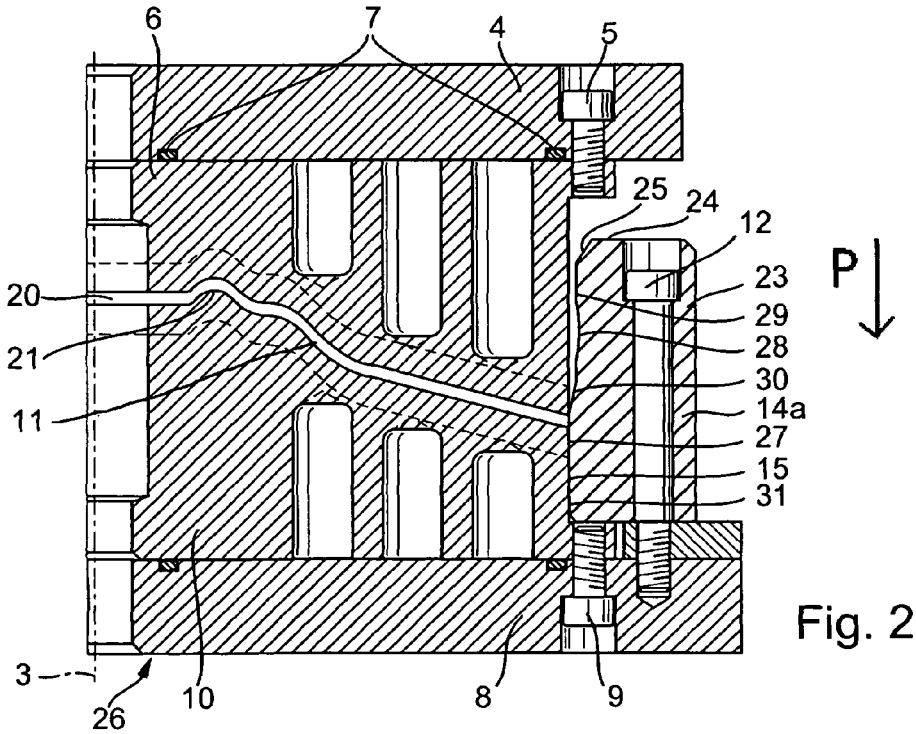
FIG. 2 shows an illustration similar to FIG. 1, but with a calibration tool in accordance with an embodiment in accordance with the present invention.

FIG. 2 of the drawing thus shows a sectional view similar to the one in accordance with FIG. 1, wherein, however, the known calibration tool 2 is replaced with a calibration tool 23 in accordance with the invention. Identical reference numerals otherwise designate identical components.

The calibration tool 23 in accordance with the invention includes an insertion bevel 25 at its face end portion 24, which bevel is used for receiving and centering a workpiece 20 in the die cavity 11 of the forming tool 26 configured with the calibration tool 23 in accordance with the invention.

As is readily apparent, the calibration tool 23 in accordance with the invention includes a circular cylindrical tool body, which includes a tool surface 27 at its inner circumferential enveloping surface.

The tool surface 27 includes a circular segment shaped indentation 28 in the sectional view including the longitudinal axis or the axis of symmetry 3, which indentation is disposed in the portion below the insertion bevel 25, with a first portion 29 having an inner diameter that increases along the axial longitudinal direction in accordance with the arrow P of the tool body, and a second portion 30, whose inner diameter becomes smaller again in the direction of the arrow P.

When the forming tool 26 closes with a workpiece 20 disposed in the die cavity 11, then the portion of the workpiece 20 disposed between the support surface 21 at the lower die 10 and the radially outwardly disposed outer diameter portion of the workpiece 20 performs a rotational movement at the support portion 21, which leads to a rotational movement of the point disposed at the outer diameter portion 22, which movement has a movement path that corresponds with the circular segment shaped indentation 28 at the tool surface 27 of the calibration tool 23 in accordance with the invention.

That illustration emphasizes that no radially inwardly oriented force loading of the portion of the workpiece between the support surface 21 and the outer diameter portion 22 is performed during said rotational movement about the support surface 21, due to the indentation 28 of the tool surface 27.

Thus, there is no upsetting with a resulting warping of the workpiece 21, as occurs with the known calibration tool 2. Only when the workpiece 20 moves radially sideways from its position centered relative to the lower die 10 and relative the upper die 6 during the forming process, there is a brief contact between the workpiece 20 and the tool surface 27, which moves the workpiece 20 back into its centered position, while, on the other hand, there is no undesired force loading of the workpiece viewed in the radially inward direction.

Adjacent to the portion of the tool surface 27 configured with the indentation 28, there is a straight third portion 31, which includes a substantially constant inner diameter, which straight portion is adjacent to the portion of the inner circumferential surface of the tool surface 27 opposite to the insertion bevel 25.

The calibration tool in accordance with the invention and the forming tool in accordance with the invention facilitate the fabrication of disk springs that are not subject to undesirable upsetting and warping during forming, and thus include a symmetrical configuration along the circumference with constant spring force components of the disk spring tongues about the circumference.

Features of the invention not described in detail above can certainly be found in the claims and in the drawing figure. And although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A calibration tool for fabricating disk springs, said calibration tool comprising: a circular cylindrical tool body that includes a circular opening having an insertion bevel at an upper face end portion for receiving and centering a workpiece within an inner circumferential enveloping surface of the tool body opening, and a tool surface at the inner circumferential enveloping surface for aligning the workpiece relative to a movable die disposed within the inner circumferential enveloping surface, wherein the tool surface includes a first surface portion having an inner diameter that increases in size along the axial longitudinal direction of movement of the movable die into the tool body, and a second surface portion having an inner diameter that decreases in size along the axial longitudinal direction of movement of the movable die into the tool body, whereby no radially inwardly oriented force loading of the workpiece occurs during movement of the movable die into the tool body to form the disk spring and cause internal stress within the workpiece that results in warping of the workpiece.

2. A calibration tool according to claim 1, wherein the first portion is disposed adjacent to the insertion bevel.

3. A calibration tool according to claim 1, wherein the first portion and the second portion are disposed adjacent to one another.

4. A calibration tool according to claim 1, wherein the tool surface includes a circular segment shaped indentation interconnecting the first portion and the second portion in a cross-sectional view taken along a longitudinal axis of the tool body.

5. A calibration tool according to claim 1, wherein the tool surface includes a shape in the portion of the first portion and of the second portion in a cross-sectional view taken along a longitudinal axis of the tool body, which shape substantially corresponds to a movement path of a point at an outer diameter of the workpiece during formation of the workpiece into a disk spring.

6. A calibration tool according to claim 1, wherein the tool surface includes a third portion adjacent to the second portion, which third portion has a substantially constant inner diameter.

7. A calibration tool according to claim 6, wherein the third portion extends to a lower face surface of the tool body, which lower face surface is disposed at a lower face end of the tool body that is opposite to the upper face end adjacent to the insertion bevel.

8. A calibration tool according to claim 1, wherein in an axial longitudinal direction of the tool body a ratio of a length of the first and second surface portions of the tool surface having varying inner diameters to a length of the tool surface portion having a substantially constant inner diameter is approximately 2:1.

9. A forming tool for fabricating disk springs, said forming tool comprising: an upper die and a lower die forming a die cavity for receiving a workpiece to be formed into a disk spring, wherein the die cavity is enclosed by a calibration tool having a circular cylindrical tool body that includes a circular opening having an insertion bevel at an upper face end portion for receiving and centering a workpiece within an inner circumferential enveloping surface of the tool body opening, and a tool surface at the inner circumferential enveloping surface for aligning the workpiece relative to a movable die disposed within the inner circumferential enveloping surface, wherein the tool surface includes a first surface portion having an inner diameter that increases in size along the axial longitudinal direction of movement of the movable die into the tool body, and a second surface portion having an inner diameter that decreases in size along the axial longitudinal direction of movement of the movable die into the tool body, whereby no radially inwardly oriented force loading of the workpiece occurs during movement of the movable die into the tool body to form the disk spring and cause internal stress within the workpiece that results in warping of the workpiece.

10. A forming tool according to claim 9, wherein the lower die includes an inner support surface facing the upper die for supporting the workpiece, which support surface is disposed in an axial longitudinal direction of the calibration tool below a front end portion of the cylindrical tool body of the calibration tool, which front end portion includes an insertion bevel.

* * * * *